United States Patent [19]

Massa

[11] 4,281,484

[45] Aug. 4, 1981

[54] SYSTEM FOR PRECISELY AND ECONOMICALLY ADJUSTING THE RESONANCE FREQUENCE OF ELECTROACOUSTIC TRANSDUCERS

[75] Inventor: Frank Massa, Cohasset, Mass.

[73] Assignee: The Stoneleigh Trust, Cohasset, Mass. ; Fred M. Dellorfano, Jr. & Donald P. Massa, Trustees

[21] Appl. No.: 120,712

[22] Filed: Feb. 11, 1980

[51] Int. Cl.[3] ..... B24B 49/00

[52] U.S. Cl. ..... 51/413; 51/165 R

[58] Field of Search ..... 51/165 R, 413

[56] References Cited

U.S. PATENT DOCUMENTS

| | | | |
|---|---|---|---|
| 2,345,648 | 4/1944 | Wolfskill | 51/413 |
| 4,063,910 | 12/1977 | Huguenin | 51/413 |
| 4,199,902 | 4/1980 | Sauerland | 51/165 R |

*Primary Examiner*—Harold D. Whitehead

[57] ABSTRACT

The resonance frequency of an electroacoustic transducer is precisely and quickly adjusted by the continuous removal of material from the vibratile surface while the resonance frequency is continuously monitored. The material removal rate is electronically controlled and is automatically decreased as the resonance frequency of the transducer approaches close to the desired specified value. The removal of material is automatically stopped at the precise instant when the adjusted resonance frequency becomes equal to the desired specified value.

9 Claims, 3 Drawing Figures

SYSTEM FOR PRECISELY AND ECONOMICALLY ADJUSTING THE RESONANCE FREQUENCE OF ELECTROACOUSTIC TRANSDUCERS

This invention is concerned with an improved system for adjusting the resonance frequency of an electroacoustic transducer, and more particularly with the adjustment of either the resonance or anti-resonance frequency of the transducer. It is well known that electroacoustic transducers designed for use in the ultrasonic or near ultrasonic frequency region generally employ resonant vibratile structures if high electroacoustic efficiency is desired. It is also well known that the mechanical Q of a resonant vibratile transducer structure is generally relatively high and, as a result, the frequency response characteristics of such transducers are of very narrow band width. When such transducers are used to provide an acoustic link in an electroacoustic system such as an ultrasonic intrusion alarm, for example, it is essential that the transmitting and receiving transducers be precisely tuned to give maximum sensitivity at the desired frequency of operation of the system.

Various methods have been developed for accomplishing the final tuning adjustment of resonant transducers, and the adjustment procedure has fallen into two broad classes. In one method for adjusting the resonance frequency, the mechanical tolerances of the vibrating structure are chosen such that the deviation in resonance frequency among the production elements falls above the desired operating frequency, and a selected weight is added to the vibratile element to increase its effective mass and thereby reduce the resonance frequency by the required amount to reduce the resonance to the specified value. This procedure has been described in U.S. Pat. No. 3,128,532. Another procedure in which the surface of the diaphragm is machined in small increments to reduce its thickness to bring the resonance to the desired value is also described in the referenced patent. Still another procedure is described in the same patent in which the resonance frequency of a vibratile element is adjusted by removing material from the periphery of the element to raise the resonance frequency of the vibratile element to the desired value.

These prior art methods for adjusting the resonance frequency of electroacoustic transducers have accomplished their intended objectives, but the added cost for performing the adjustment can not always be justified for low-cost mass-production transducers. Also, because of the incremental nature of adding selected weights or removing incremental amounts of material from the surfaces of the vibratile element, it was not possible to perform the frequency adjustment operation continuously while the resonance frequency was being simultaneously monitored; therefore, a direct adjustment of the resonance frequency to a precise specified value could not be quickly achieved. Another limitation to the prior art method of removing material from the surface of the diaphragm by grinding or machining is caused by the fact that during the material removal operation, the temperature of the diaphragm is increased, and the frequency measurements must be delayed to allow for cooling between the incremental removal of material.

For low-cost mass-production applications, it has been the general practice to accept a manufacturing tolerance of several percent in the resonance frequency of transducers to accommodate the average variation in the mechanical tolerances of the components which are part of the vibratile system assembly. After final assembly, instead of further adjustment of the resonance frequency to a uniform precise specified value, the resonance frequencies are measured, and the transducers are separated into matched lots for use at the average resonance frequency indicated for each separately selected lot. Each separate transducer lot is then coded and used only at a specified system operating frequency corresponding to the designated average resonance frequency of the selected lot.

This invention overcomes the limitations of the prior art and provides a low-cost precise method for quickly and continuously adjusting the resonance frequency of an electromechanical vibrating system to an exact specified value. The invention permits the continuous removal of material from the surface of the vibratile element without raising the temperature of the element and without physical contact of machine tool surfaces with the surface of the vibratile element. During the material removal operation, the resonance frequency of the vibratile element is continuously monitored, and at the specified value of resonance frequency, the removal of material is stopped and the resonance frequency of the transducer is thus automatically adjusted to the precise specified value.

The primary object of this invention is to provide a system for continuously removing material from the surface of a vibratile element while the resonant frequency of the vibratile element is being continuously monitored and to automatically stop the material removal procedure when the resonance frequency reaches the specified value.

Another object of this invention is to provide an economical method for adjusting the resonance frequency of an electroacoustic transducer by the continuous removal of material from the vibratile surface of the electroacoustic transducer while the motional impedance of the transducer is being monitored, and to stop the removal of material from the vibratile surface when the motional impedance measurement indicates that the specified resonance frequency has been reached for the transducer.

Still another object of this invention is to provide an economical method for adjusting the resonance frequency of an electromechanical vibrating system by the continuous removal of material from the vibrating surface of the electromechanical vibrating system while the resonance frequency of the vibrating system is being monitored and automatically stopping the removal of material from the vibrating surface when the specified resonance frequency has been reached.

An additional object of this invention is to rapidly and automatically adjust the resonance frequency of an electroacoustic transducer by continuously measuring and electronically tracking either the minimum or maximum value of the motional impedance of the transducer while material is being continuously removed from the vibratile surface of the transducer, and to electronically control the relative rate of material removal as a function of the difference in the measured value of the resonance frequency and the desired specified value of the resonance frequency so that the rate of removal of material is taking place at a relatively lower rate as the actual measured resonance frequency of the transducer approaches closer to the specified resonance frequency desired.

The novel features which are characteristic of this invention are set forth with particularity in the appended claims. However, the invention itself both as to its organization and method of operation will best be understood by reference to the following description taken in conjunction with the accompanying drawings in which:

FIG. 1 is a schematic representation of one embodiment of my invention which illustrates a widely used type of ultrasonic ceramic-driven diaphragm-type electroacoustic transducer whose motional impedance is being monitored while material is being removed from the diaphragm surface to adjust the resonance frequency. A control logic circuit responsive to the motional impedance characteristic of the transducer stops the material removal when the specified resonance frequency is reached.

Figure 1:
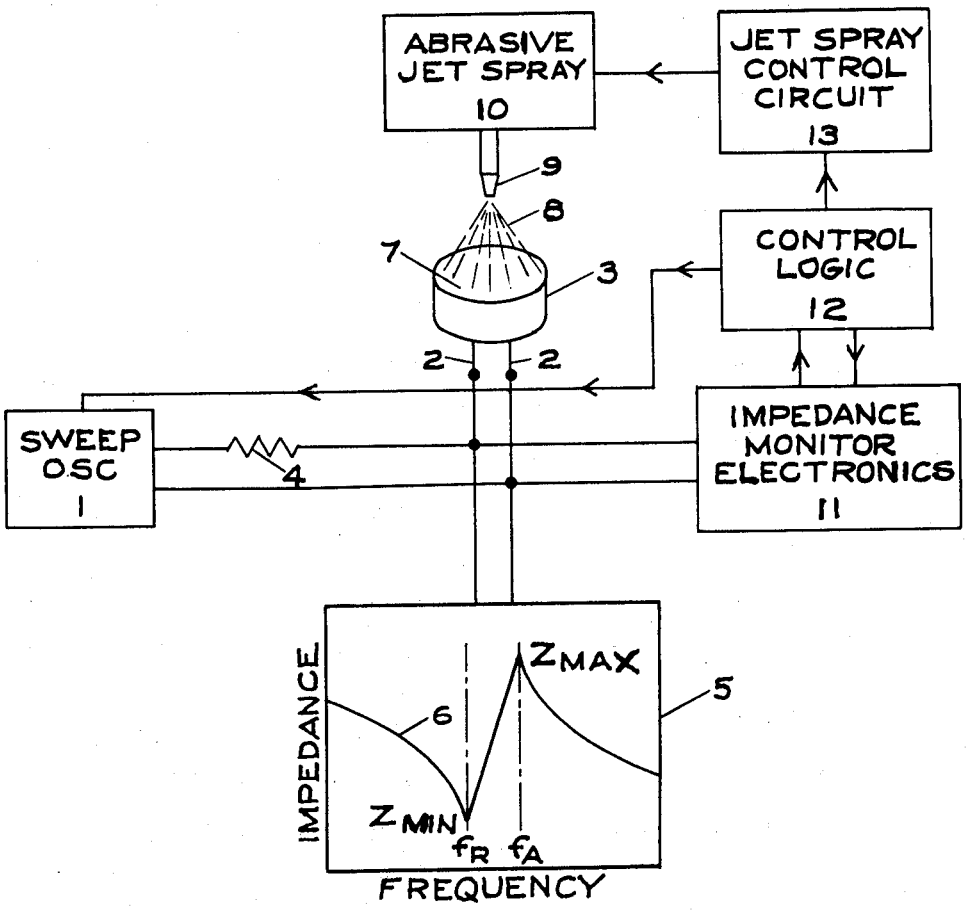

Referring specifically to FIG. 1, the output of a sweep oscillator 1 is connected to the terminals 2—2 of the transducer 3. A resistor 4, whose resistance value is preferably at least ten times the maximum value of the motional impedance of the transducer over the sweep frequency range, is connected in series with the output of the sweep oscillator, as illustrated. The use of the series resistor in combination with the constant voltage oscillator output will maintain constant current through the transducer 3 as the frequency sweeps through the transducer's resonance frequency region. If an oscilloscope 5 is connected across the transducer terminals with the vertical axis displacement adjusted to indicate the magnitude of the voltage appearing across the transducer and the horizontal axis adjusted to indicate the frequency during the sweep, the trace illustrated by curve 6 will represent the motional impedance magnitude of the transducer as a function of frequency. In this illustrative example, the electroacoustic transducer 3 includes a vibratile diaphragm 7 which is driven by a polarized ceramic disc attached to the inner surface of the diaphragm (not shown) as is well known to anyone skilled in the art of transducer design.

As the frequency applied to the transducer terminals is swept, the motional impedance of the transducer will become a minimum, $Z_{MIN}$, at its resonant frequency $f_R$, and its impedance will become a maximum, $Z_{MAX}$, at its anti-resonant frequency $f_A$. If two transducers are to be used as a transmitter and receiver pair at an operating frequency $f_0$, it is desirable that the motional impedance $Z_{MIN}$ for the transmitter be made to occur at the specified operating frequency $f_0$, and also that the motional impedance $Z_{MAX}$ for the receiver be made to occur at the operating frequency $f_0$. Under such conditions, the maximum acoustic output per volt will be generated by the transmitter at the specified operating frequency, and the maximum receiver sensitivity will also be achieved at the specified operating frequency. If the manufacturing tolerances for the transducer illustrated in FIG. 1 are so chosen that the variations in $Z_{MIN}$ for the transmitters and the variations in $Z_{MAX}$ for the receivers all lie above the specified operating frequency $f_0$, then the resonance frequency of each transducer may be automatically adjusted by the system illustrated in FIG. 1 so that all the transmitters will have their motional impedances $Z_{MIN}$ set to occur at precisely the specified operating frequency $f_0$, and, similarly, the receivers will have their motional impedances $Z_{MAX}$ set to occur at the same specified operating frequency $f_0$.

In order to accomplish the continuous resonance frequency adjustment of the transducer 3, an air-jet abrasive spray 8 is discharged from the nozzle 9 of an air abrasive machine 10. Such machines are well known in industry such as, for example, the Airbrasive machines manufactured by S. S. White Industrial Products, 151 Old New Brunswick Rd., Piscataway, N.J. The nozzle pressure may be adjusted to permit the removal of material at any desired rate. For example, the adjustment may be made such that the material removal rate may be sufficiently low to cause a resonance frequency change at a rate as slow as 1 Hertz per second, or the material removal rate may be increased to cause a resonance frequency change at a rate as fast as several hundred Hertz per second.

Although the teachings of this invention may be carried on with a fixed material removal rate setting of nozzle pressure throughout the resonance frequency adjustment cycle, a preferred embodiment of the invention is to use a variable electronically-controlled material removal rate that automatically removes material at a relatively lower rate as the adjusted resonance frequency of the transducer approaches closer to the desired specified value. In this manner, the frequency adjustment process may be accomplished in a very short time and with very great precision. It is also advantageous in specific instances to electronically control the rate of the sweep of the oscillator as well as the frequency range of the sweep, as will be described, to achieve further reduction in the time required to complete the automatic adjustment of the transducer resonance within a few seconds, and to achieve a further increase in the precision of the frequency adjustment to a tolerance as low as about 0.01% as compared with a tolerance in the order of 1% which is the best that can be economically realized by previous state-of-the-art mass-production techniques.

In the schematic representation of a preferred embodiment of the inventive system illustrated in FIG. 1, an impedance-monitoring electronic circuit 11 is connected across the transducer terminals 2 for sensing the variation of the voltage across the transducer terminals during each frequency sweep which represents the motional impedance variation of the transducer during each sweep. The electronic system also includes control logic circuits illustrated by the block diagram 12, which are well known in the art of digital electronics and microprocessors, to perform the necessary recognition and control functions for the system, including the continuous measurement of the exact frequency at which either $Z_{MIN}$ or $Z_{MAX}$ occurs during each sweep, and also to control both the rate and band width of the frequency sweep to accomplish the desired objectives of the invention. The magnitude of the motional impedance, which corresponds to the magnitude of the voltage appearing across the transducer terminals, is monitored by the impedance monitor electronics 11 as the oscillator frequency is varied. The frequency measurement at the occurrence of either $Z_{MIN}$ or $Z_{MAX}$ during the sweep is made in the conventional well-known manner of counting the number of pulses from a high-frequency crystal-controlled clock during one or more periods of the sweep oscillator frequency.

The circuit 12 includes logic for detecting the sharp reversals in the rate-of-change of the voltage across the transducer terminals which corresponds to $Z_{MIN}$ or $Z_{MAX}$, as illustrated in the oscilloscope trace 6. Upon the detection of a sharp reversal in the rate-of-change of motional impedance versus frequency from an increasing to a decreasing rate, which occurs when the frequency is changing in the vicinity of $Z_{MAX}$, or alternately, upon the detection of an opposite reversal in the rate-of-change of motional impedance versus frequency from a decreasing rate, which occurs when the frequency is changing in the vicinity of $Z_{MIN}$, the logic circuit will generate a logic signal to control the sweep rate of the oscillator 1 to cause the sweep to be reversed in direction immediately after each recognition of the reversal in the rate-of-change of the motional impedance which takes place as the frequency is sweeping selectively either in the vicinity of $Z_{MIN}$ or $Z_{MAX}$. Thus the oscillator sweep is being automatically controlled to selectively track either the resonance or anti-resonance frequency of the transducer $Z_{MIN}$ or $Z_{MAX}$, as desired, while material is being removed from the vibratile surface of the transducer to selectively adjust either the resonance or anti-resonance frequency to a specified value. Additional logic can be provided in the jet spray control circuit 13 to reduce the intensity of the jet spray from the machine 10 as the measured resonance frequency of the transducer approaches close to the desired specified operating frequency. This additional control is particularly advantageous where a very high degree of precision is desired for adjusting the transducer resonance frequency. The logic circuit 12 also includes logic to perform the control function for turning off the abrasive jet spray machine 10 when the resonance frequency of the transducer has reached the specified value.

Transducers being mass-produced for ultrasonic control systems generally operate in the frequency region above 25 kHz. This means that an adjustment of the resonance frequency of the transducer within a few Hertz of a specified value, which can be accomplished by the inventive system, represents a variation in the order of 0.01% in the frequency adjustment, which is completely negligible for most applications. A variation in frequency as much as 100 times greater is considered an excellent achievement in production uniformity when using prior art methods for adjusting the resonance frequency of transducers. Details of the electronic circuits to perform the functions described have not been shown because they are well known in the art of digital electronics and computer science, and the electronic circuit details are not, in themselves, a part of this invention.

The use of the air-jet abrasive material removal system develops no heat, such as occurs with grinding wheels or sanding discs. Also, because there is no physical contact by machine tools with the surface of the vibratile diaphragm during the material removal operation, the motional impedance measurement can be made continuously during the material removal procedure while the oscillator frequency is swept at a rate greater than one sweep per second, and the precise adjustment of the resonance frequency is completed automatically within a few seconds, as compared with as much as several minutes which may be required with the resonance frequency adjustment procedures used prior to this invention.

Figure 2:
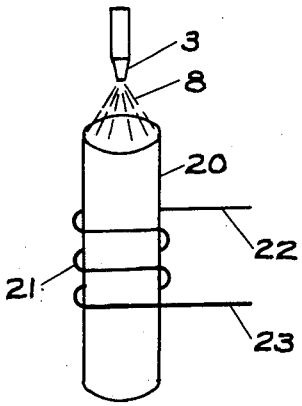
FIG. 2 illustrates a half wavelength magnetostriction resonator element whose resonant frequency can be precisely adjusted by connecting the magnetostriction resonator in place of the electroacoustic transducer in FIG. 1.

FIG. 2 illustrates a half-wavelength magnetostriction vibrator 20, well known in the art, which includes a surrounding coil 21 with terminals 22 and 23. If the magnetostriction resonator 20 is substituted for the transducer 3 in FIG. 1 and the terminals 22, 23 are connected in place of the transducer terminals 2, the same frequency adjustment procedure described above for the transducer 3 can be used to adjust the frequency of the resonator 20.

Figure 3:
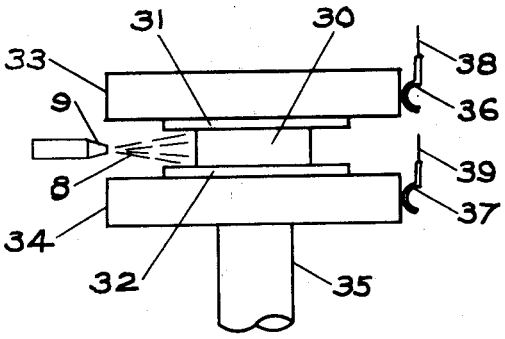
FIG. 3 illustrates a schematic arrangement for precisely adjusting the planar resonance frequency of a piezoelectric ceramic disc by removing material from the periphery of the disc.

FIG. 3 illustrates another application of the inventive system for the adjustment of the planar resonance frequency of a polarized ceramic disc. The ceramic disc 30 is shown in an edge-wise view with its two opposite plane surfaces held between electrically conducting foam rubber pads 31 and 32 which serve to establish electrical connection from the ceramic disc electrode surfaces to the metal discs 33 and 34. The bottom metal disc 34 is connected to a motorized shaft 35 which provides rotary motion for the disc 34. Gravity maintains contact of the electrically conducting pads 31 and 32 to the electrode surfaces of the ceramic disc 30. The outer edges of the metal discs 33 and 34 act as slip rings, and spring contact members 36, 37 make sliding electrical contact from the rotating slip ring surfaces to the terminal conductors 38 and 39, as illustrated schematically in FIG. 3. The top metal disc 33 includes guide means (not shown) to hold its center in axial alignment with the bottom disc 34. Means are also provided (not shown) for separating the two disc members 33 and 34 for removing the ceramic 30 after completing the adjustment of its resonance frequency. The details of the mechanical structure are not shown in the schematic illustration of FIG. 3 because they are obvious to any mechanical engineer, and their details are not part of this invention.

If the terminals 38 and 39 are connected in place of terminals 2—2 in FIG. 1 and the nozzle 9 is mounted to direct the jet spray 8, as illustrated in FIG. 3, then the system of FIG. 1 can be used for automatically adjusting the planar resonant frequency of the ceramic disc in the same manner as described above for adjusting the resonance frequency for the other transducer structures. In the example of FIG. 3, the ceramic disc is rotated when the motorized shaft 35 is set in motion and the air-jet abrasive spray 8 removes material from the outer periphery of the ceramic disc 30, as illustrated. As the material is removed, the resonance frequency of the ceramic disc increases until it reaches the specified value at which instant the abrasive jet-spray is turned off by the control logic circuits, as previously described, and the ceramic is released from the fixture. The conducting foam rubber pads 31 and 32 are selected in softness to have no effect on the resonance frequency of the ceramic when the rubber pads are held in contact with the ceramic surfaces, as illustrated in FIG. 3.

In the example illustrated in FIG. 1, the resonance frequency of the vibratile diaphragm 7 is lowered as material is removed from its surface; therefore, the manufacturing tolerances for the transducer 3 are so chosen that the resonance frequency variation of the production transducers fall above the specified operating value. For the examples illustrated in FIGS. 2 and 3, the resonance frequencies of the elements will increase as material is removed from the surfaces; therefore, the manufacturing tolerances for the elements 20 and 30 are chosen to make the resonance frequency variations among the production elements fall below the specified operating values.

Several examples have been given to illustrate some of the various uses that can be made of the disclosed invention. The use of the inventive system for automatically and precisely adjusting the resonance or anti-resonance frequency of large quantities of production electroacoustic transducers has made it possible to manufacture ultrasonic transducers with accurately controlled frequency tolerances at low cost and with greatly improved sensitivity and uniformity of the operating characteristics for the transducer system.

Other embodiments of my invention will readily occur to those who are skilled in the art. Hence, the appended claims are to be construed broadly enough to cover all equivalents falling within their true spirit and scope.

I claim:

1. In combination in an apparatus for selectively adjusting the resonance or anti-resonance frequency of an electroacoustic transducer by the removal of material from a specified surface region of the vibatile element portion of said electroacoustic transducer, means for propelling a spray of abrasive particles, means for controlling the intensity of said spray, means for controlling the distribution pattern of said abrasive particles being propelled by said spray, means for supporting said transducer vibratile element and said abrasive particles spray propelling means, said support means characterized in that said specified surface portion of said vibratile element is exposed to the spray pattern of said abrasive particles, electronic circuit means for selectively monitoring the resonance or anti-resonance frequency of said electroacoustic vibratile element while said specified surface of said vibratile element is being exposed to said spray of abrasive particles, said electronic circuit means characterized in that it includes control means for terminating the exposure of said specified surface portion of said vibratile element to said spray of abrasive particles when the resonance or anti-resonance frequency of said vibratile element reaches a specified value.

2. The invention in claim 1 characterized in that said electronic circuit means for selectively monitoring the resonant or anti-resonant frequency of said electroacoustic vibratile element includes motional impedance measurement means for selectively indicating the resonance or anti-resonance frequency of said vibratile element.

3. The invention in claim 1 characterized in that said electronic circuit means for selectively monitoring the resonance or anti-resonance frequency of said vibratile element includes a sweep oscillator for driving said vibratile element repetitively over a specified frequency range, said specified sweep frequency range being sufficiently broad to include the frequency range over which it is required to adjust the resonance or anti-resonance frequency of said vibratile element.

4. The invention in claim 3 further characterized in that the repetition rate of said sweep frequency is greater than one sweep per second.

5. In combination in an apparatus for selectively adjusting the resonance or anti-resonance frequency of an electroacoustic transducer by the removal of material from a specified vibratile surface portion of said transducer, means for propelling a spray of abrasive particles, means for controlling the intensity of said spray, means for controlling the distribution pattern of said abrasive particles being propelled by said spray, support means for said electroacoustic transducer and said spray propelling means, said support means characterized in that said vibratile surface portion of said transducer is exposed to the spray pattern of said abrasive particles, a source of variable frequency electrical power, means for repetitively sweeping the frequency of said source of electrical power between specified frequency limits, first circuit means for connecting said variable frequency electrical power source to said transducer, second circuit means associated with said first circuit means for producing a reference electrical signal whose magnitude is representative of the motional impedance of said electroacoustic transducer while the frequency of the electrical power supplied to said transducer is being varied, an electronic circuit including first logic circuit means responsive to the rate-of-change of the motional impedance of said electroacoustic transducer as the frequency of said source of electrical power is being varied, first control circuit means for turning off said propelled spray of abrasive particles, said first control circuit means characterized in that it is responsive to a first logic signal generated by said first logic circuit means, said first logic signal characterized in that it may be selectively generated either when the rate-of-change of the motional impedance is reversed from a decreasing to an increasing rate-of-change at a particular specified frequency or when the rate-of-change of the motional impedance is reversed from an increasing to a decreasing rate-of-change at a particular specified frequency.

6. The invention in claim 5 characterized in that said electronic circuit includes a second logic circuit means responsive to the rate-of-change of motional impedance as the frequency of said source of electrical power is being varied in the vicinity of the resonance frequency of said transducer, and further characterized in that a second control circuit means is provided for varying the intensity of said propelled spray of abrasive particles, said second control circuit means characterized in that it is responsive to a second logic signal generated by second logic circuit means, said second logic signal characterized in that it may be selectively generated either when the rate-of-change of the motional impedance is reversed from a decreasing to an increasing rate-of-change, or from an increasing to a decreasing rate-of-change at a frequency approaching close to said particular specified frequency, whereby a finer control is achieved by said first control circuit means in turning off the abrasive spray at the precise instant when the particular specified frequency is reached.

7. The invention in claim 5 characterized in that said electronic circuit includes a third logic circuit means responsive to a reversal in the rate-of-change of motional impedance as the frequency of said source of electrical power is being varied in the vicinity of the resonance frequency of said transducer, and further characterized in that a third control circuit is provided for reversing the direction of the frequency sweep from said source of variable frequency power, said third control circuit means characterized in that it is responsive to a third logic signal generated by said third logic circuit means, said third logic signal characterized in that it may be selectively generated either when the rate-of-change of the motional impedance is reversed from a decreasing to an increasing rate-of-change, or from an increasing to a decreasing rate-of-change.

8. The invention in claim 7 and a fourth control circuit for varying the rate-of-sweep of said variable frequency electrical power, said fourth control circuit characterized in that it is responsive to a fourth logic signal, fourth logic circuit means for generating said fourth logic signal, said fourth logic signal characterized in that it is generated when the motional impedance reversal takes place at a frequency approaching close to said particular specified frequency and further characterized in that said fourth logic signal causes said fourth control circuit to reduce the rate-of-sweep of said variable frequency electrical power source as the frequency of reversal of said motional impedance approaches closer to said particular specified frequency, whereby a finer control is achieved by said first control circuit means in turning off the abrasive spray at the precise instant when the particular specified frequency is reached.

9. A method for selectively adjusting the resonance or anti-resonance frequency of an electroacoustic transducer by the selective removal of material from a vibratile surface portion of said electroacoustic transducer which includes the following steps:

1. expose said vibratile surface portion of said electroacoustic transducer to a controlled spray of abrasive particles,
2. measure the motional impedance in the vicinity of the resonance and anti-resonance frequency of said transducer while said vibratile surface portion is being exposed to said controlled spray of adhesive particles,
3. terminate the exposure of said vibratile surface to said controlled spray of abrasive particles when the motional impedance selectively reaches either a minimum value or a maximum value at a particular specified frequency.

* * * * *